US008602219B2

(12) United States Patent
Guptail et al.

(10) Patent No.: US 8,602,219 B2
(45) Date of Patent: Dec. 10, 2013

(54) AIR BALANCING FOR VIBRATORY APPARATUS WITH AIR KNIFE

(75) Inventors: William G. Guptail, Huntley, IL (US); Steve C. Wiechmann, Sleepy Hollow, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 926 days.

(21) Appl. No.: 12/687,617

(22) Filed: Jan. 14, 2010

(65) Prior Publication Data

US 2010/0177591 A1 Jul. 15, 2010

Related U.S. Application Data

(60) Provisional application No. 61/144,539, filed on Jan. 14, 2009.

(51) Int. Cl.
*B07C 5/00* (2006.01)

(52) U.S. Cl.
USPC ..... 209/44.2; 209/44; 209/143; 209/466

(58) Field of Classification Search
USPC ..... 209/44, 44.2, 143, 466–470
See application file for complete search history.

(56) References Cited

U.S. PATENT DOCUMENTS

| | | | |
|---|---|---|---|
| 2,026,910 | A | 1/1936 | Olsen |
| 2,147,822 | A | 2/1939 | Peale, Jr. |
| 3,232,431 | A | 2/1966 | Musschoot et al. |
| 3,467,594 | A | 9/1969 | Musschoot et al. |
| 3,865,241 | A | 2/1975 | Crow |
| 4,152,255 | A | 5/1979 | Musschoot |
| 4,624,370 | A | 11/1986 | Danner et al. |
| 4,715,950 | A | 12/1987 | Danner et al. |
| 4,844,235 | A | 7/1989 | Sherman |
| 4,906,356 | A | 3/1990 | Musschoot |
| 5,108,589 | A | 4/1992 | Sherman |
| 5,462,172 | A | 10/1995 | Kumagai et al. |
| RE35,331 | E | 9/1996 | Sherman |

(Continued)

FOREIGN PATENT DOCUMENTS

| | | |
|---|---|---|
| GB | 1374204 | 11/1974 |
| JP | 04-033327 | 3/1992 |

(Continued)

OTHER PUBLICATIONS

Extended European Search Report from corresponding European Application No. EP10150744.0, dated Jan. 11, 2011 (3 pages).

*Primary Examiner* — Joseph C Rodriguez
*Assistant Examiner* — Kalyanavenkateshware Kumar
(74) *Attorney, Agent, or Firm* — Marshall, Gerstein & Borun LLP

(57) ABSTRACT

A system includes a vibratory apparatus with a housing having a floor with an opening and a chamber, a deck disposed in the chamber between the chamber inlet and the opening, a section of the deck having a plurality of apertures and a plenum defined beneath the deck section, and an air knife disposed between the deck section and the chamber outlet. The system includes an air handling system with a first path in communication with the plenum, a second path in communication with the air knife, a third path in communication with a space beneath the air knife, a fourth path in communication with the chamber above the deck between the inlet and the deck section, a return path from the outlet, and an air mover having an outlet in communication with the first, second, third, and fourth paths and an inlet in communication with the return path.

8 Claims, 7 Drawing Sheets

(56) References Cited

U.S. PATENT DOCUMENTS

| | | | |
|---|---|---|---|
| 5,904,254 | A | 5/1999 | Tinsley et al. |
| 5,984,105 | A | 11/1999 | Lease et al. |
| 6,250,472 | B1 | 6/2001 | Grubbs et al. |
| 6,446,813 | B1 | 9/2002 | White |
| 6,662,953 | B1 | 12/2003 | Rouse |
| 7,422,114 | B2 | 9/2008 | Guptail |
| 2009/0178958 | A1 | 7/2009 | Guptail et al. |

FOREIGN PATENT DOCUMENTS

| | | |
|---|---|---|
| JP | 09-192605 | 7/1997 |
| JP | 2001-079493 | 3/2001 |
| JP | 2002-177890 | 6/2002 |
| WO | WO 87/06506 | 11/1987 |

AIR BALANCING FOR VIBRATORY APPARATUS WITH AIR KNIFE

BACKGROUND

This patent is directed to air balancing for a vibratory apparatus, and in particular to air balancing for a vibratory apparatus with an air knife.

SUMMARY

According to an aspect of the present disclosure, a system includes a vibratory apparatus and an air handling system. The vibratory apparatus includes a housing having a floor with an opening therethrough, the housing defining a chamber with an inlet and an outlet, a deck disposed in the chamber between the inlet and the opening in the floor, at least a section of the deck having a plurality of apertures to permit air to flow through the section of the deck and a plenum defined beneath the section of the deck, an air knife disposed between the section of the deck and the outlet, the air knife comprising first and second surfaces spaced from each other to guide air therebetween, and a vibration generator coupled to the deck to cause motion of material along the deck. The air handling system includes a first air flow path in communication with the plenum, a second air flow path in communication with the air knife, a third air flow path in communication with a space beneath the air knife, a fourth air flow path in communication with the chamber above the deck between the inlet and the section of the deck, a return air flow path from the outlet of the chamber, and an air mover having an outlet in communication with the first, second, third, and fourth air flow paths and an inlet in communication with the return air flow path.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Furthermore, while a certain spatial conventions have been adopted for purposes of illustration, these conventions are not necessarily intended to limit the installation of the system according to the present disclosure. Consequently, terms such as up and down, upstream and downstream, and inner and outer, are simply to facilitate the discussion of the illustrated embodiment as it is shown in the attached drawings.

FIGS. 1-7 illustrate an embodiment of a system 100 including a vibratory apparatus 102 and an air handling system 104. The air handling system 104 may be connected to the vibratory apparatus 102 at several locations. According to certain embodiments of the present disclosure, the air handling system 104 is used to balance the pressures within the vibratory apparatus 102 so as to maintain a slight negative pressure in the vibratory apparatus 102. Furthermore, according to such embodiments, the maintenance of the negative pressure with the apparatus 102 is maintained through the use of air recycled within the system 100.

Figure 1:
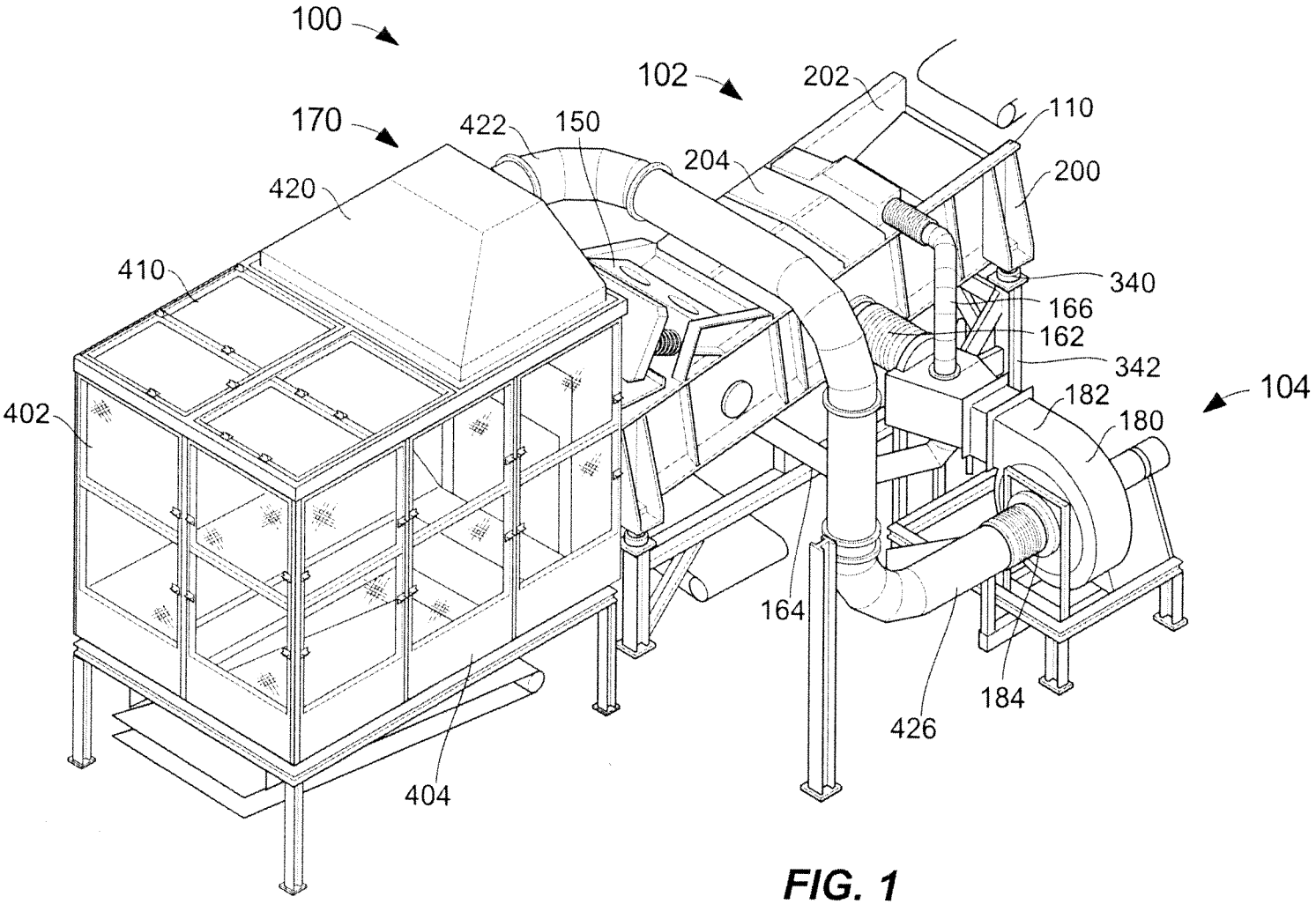
FIG. 1 is a frontal perspective view of a system including a vibratory apparatus with an air knife and an air handling system coupled to the vibratory apparatus.
Figure 2:
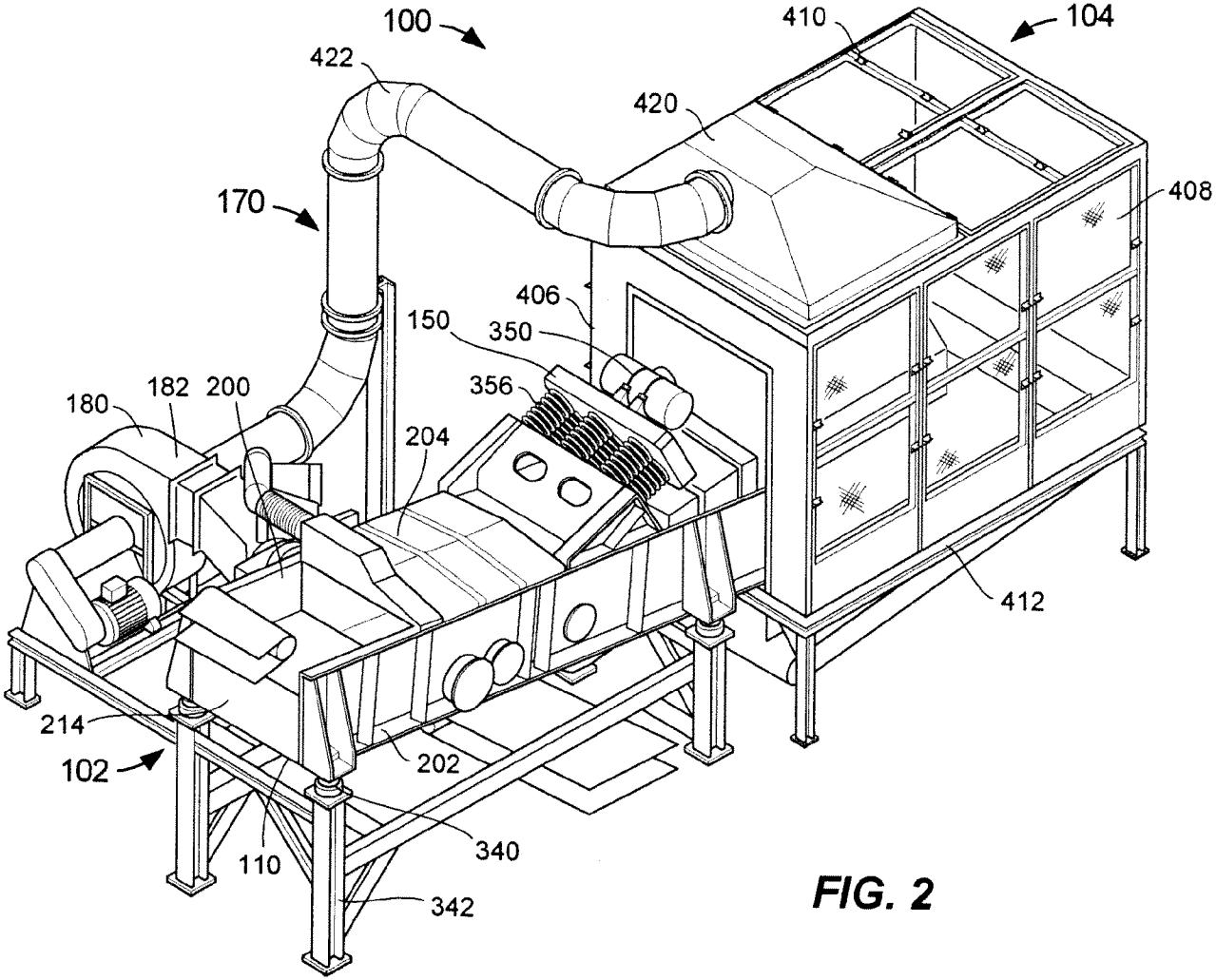
FIG. 2 is a rear perspective view of a system including a vibratory apparatus with an air knife and an air handling system coupled to the vibratory apparatus.
Figure 3:
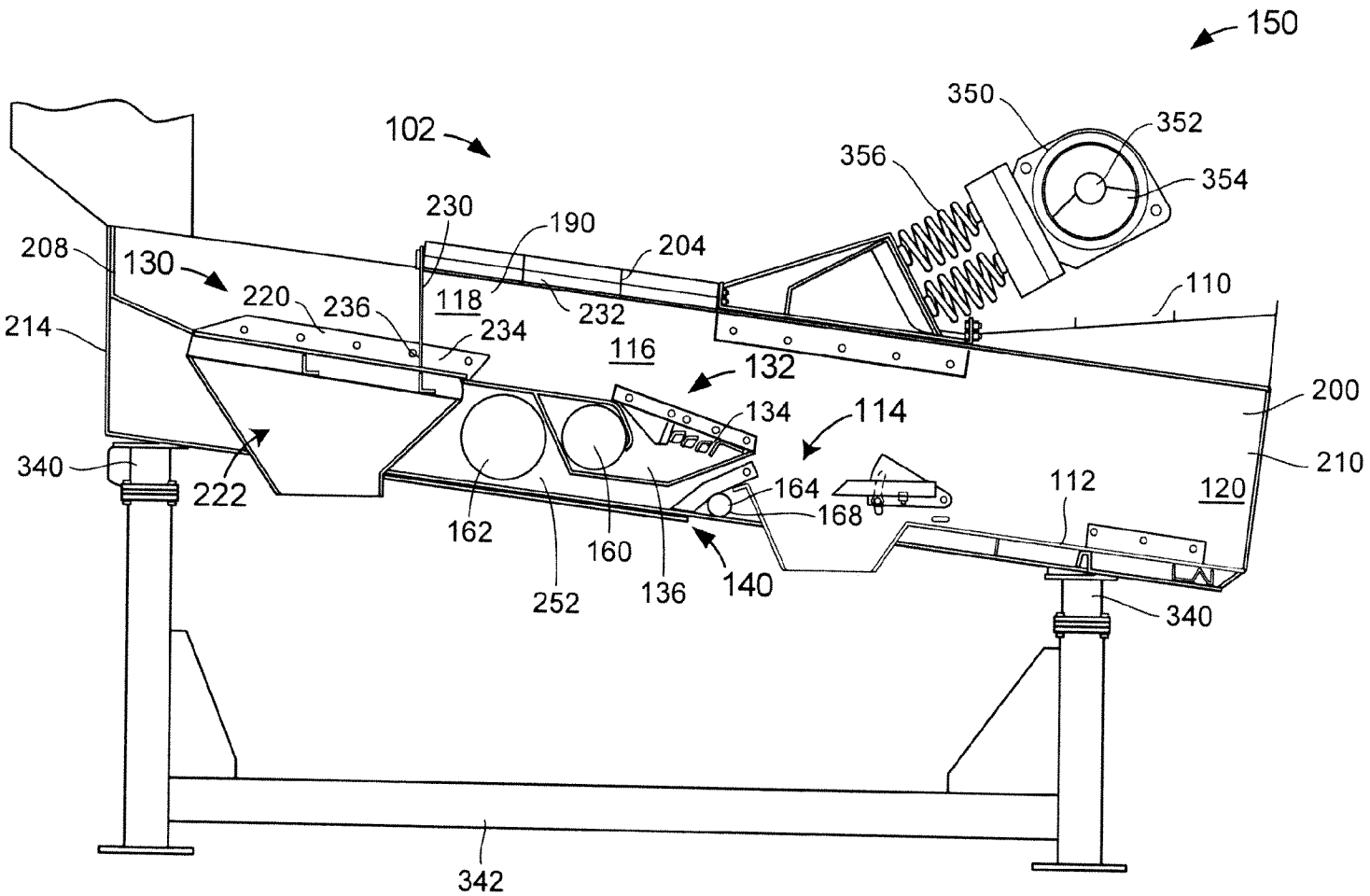
FIG. 3 is a cross-sectional view of the vibratory apparatus of FIG. 1.

As seen in FIGS. 1-6, and more particularly in FIG. 3, the vibratory apparatus 102 generally includes a housing 110 having a floor 112 with an opening 114 therethrough. The housing 110 defines a chamber 116 with an inlet 118 and an outlet 120. The apparatus 102 also includes a deck 130 disposed in the chamber 116 between the inlet 118 and the opening 114 in the floor 112. At least a section 132 of the deck 130 has a plurality of apertures 134 to permit air to flow through the section 132 of the deck 130 and a plenum 136 defined beneath the section 132 of the deck 130. The apparatus 102 also includes an air knife 140 disposed between the section 132 of the deck 130 and the outlet 120, the air knife 140 including first and second surfaces 142, 144 (see FIG. 4) spaced from each other to guide air therebetween. Further, the apparatus includes a vibration generator 150 coupled to the deck 130 to cause motion of material along the deck 130.

Furthermore, as seen in FIGS. 1, 2, 5 and 6, the air handling system 104 includes a first air flow path 160 in communication with the plenum 136, a second air flow path 162 in communication with the air knife 140, a third air flow path 164 in communication with a space 168 beneath the air knife 140 (see FIG. 3), and a fourth air flow path 166 in communication with the chamber 116 above the deck 130 between the inlet 118 and the section 132 of the deck 130 (see also FIG. 3). Additionally, the air handling system 104 includes a return air flow path 170 from the outlet 120 of the chamber 116. An air mover 180 is included in the air handling system 104 with an outlet 182 in communication with the first, second, third, and fourth air flow paths 160, 162, 164, 166 and an inlet 184 in communication with the return air flow path 170.

In operation, air exiting the air knife 140 has a tendency to create a negative pressure in the space 168 beneath the air knife 140. Further, a negative pressure may be created in the general area 190 (FIG. 3) above the deck 130 between the inlet 118 to the chamber 116 and the section 132 of the deck 130. The negative pressure beneath the air knife 140, if not balanced, may cause the air exiting the knife 140 to be deflected in the direction of the floor 112 and may cause unwanted changes in the paths of materials passing through apparatus 102. Similarly, the negative pressures in the area 190 above the deck 130 can cause unwanted motion in the material passing through the apparatus 102.

The air handing system 104 according to the present disclosure provides an offsetting air flow to balance the negative pressure that would otherwise develop in the space 168. As a consequence, the path of the material flowing past the knife 140 may be more predictable, providing for better and more predictable separation of the materials. A similar improvement in predictability may be achieved when the offsetting air flow is provided to the space 190. Moreover, where the offsetting flows are provided from air recycled from the outlet 120 of the chamber 116, the system 100 limits the amount of air exiting the system 100 that must otherwise be processed before it can be released.

It will be recognized that while air flow paths 164, 166 have been provided to balance the negative pressures that build below the air knife 140 and within the chamber 116, both air flow paths 164, 166 need not be provided in every embodiment of the system 100 according to the present invention. For that matter, it is not a requirement that the fluidizing stage defined by section 132 of the deck 130 be provided according to every embodiment. It is possible, according to the present disclosure, simply to provide the third air flow path 164 to balance the negative pressure that builds under the air knife 140, thereby preventing this negative pressure to draw air into the housing 110 in an uncontrolled fashion and/or amount.

Each of the apparatus 102 and the air handling system 104 is now discussed in greater detail relative to FIGS. 1-7. It will be appreciated that the illustrated embodiments are simply one embodiment according to the present disclosure. As is noted herein, certain structures illustrated in FIGS. 1-7 may be absent in other embodiments while remaining with the scope of the present disclosure.

Figure 4:
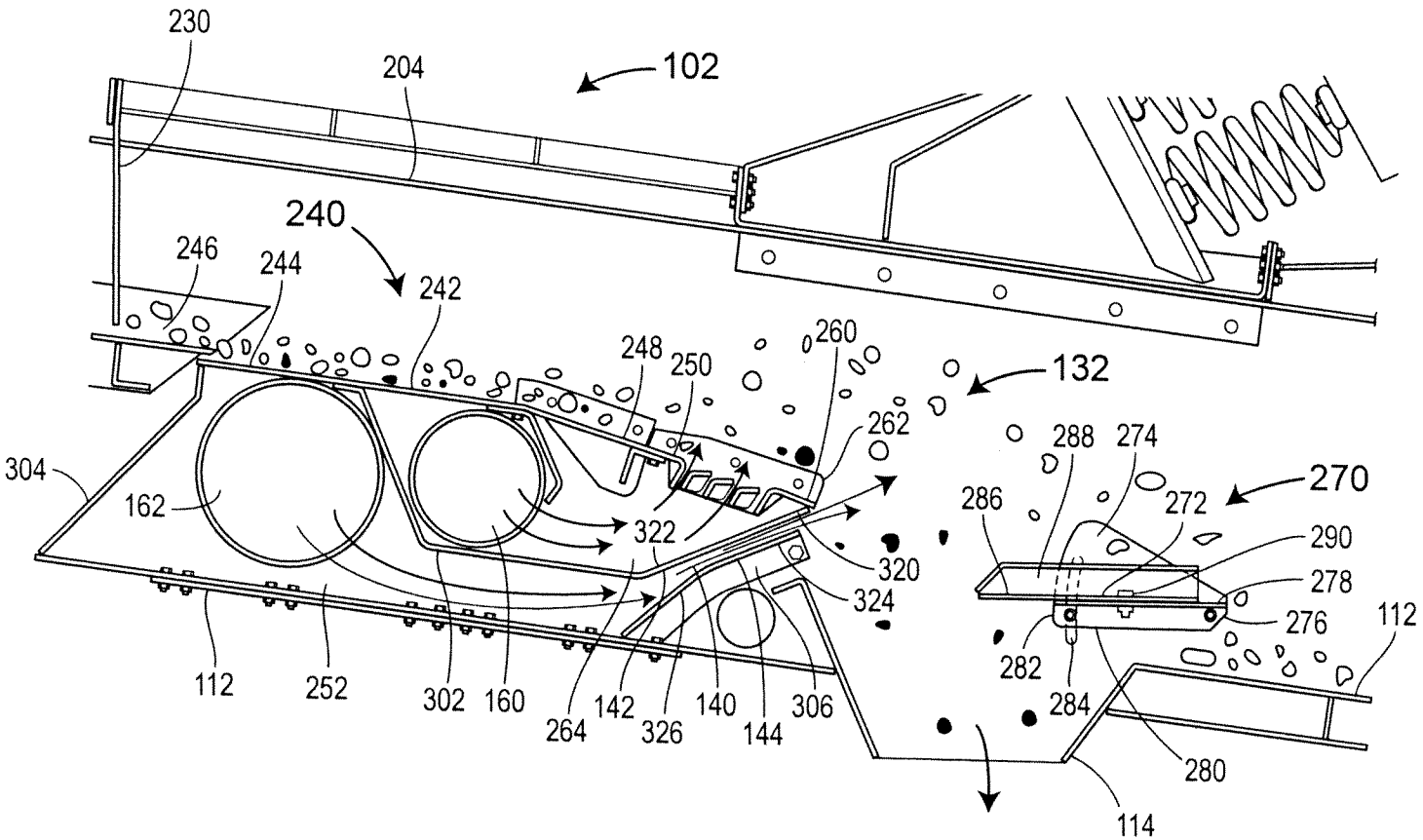
FIG. 4 is an enlarged, cross-sectional view of the vibratory apparatus of FIG. 1.
Figure 6:
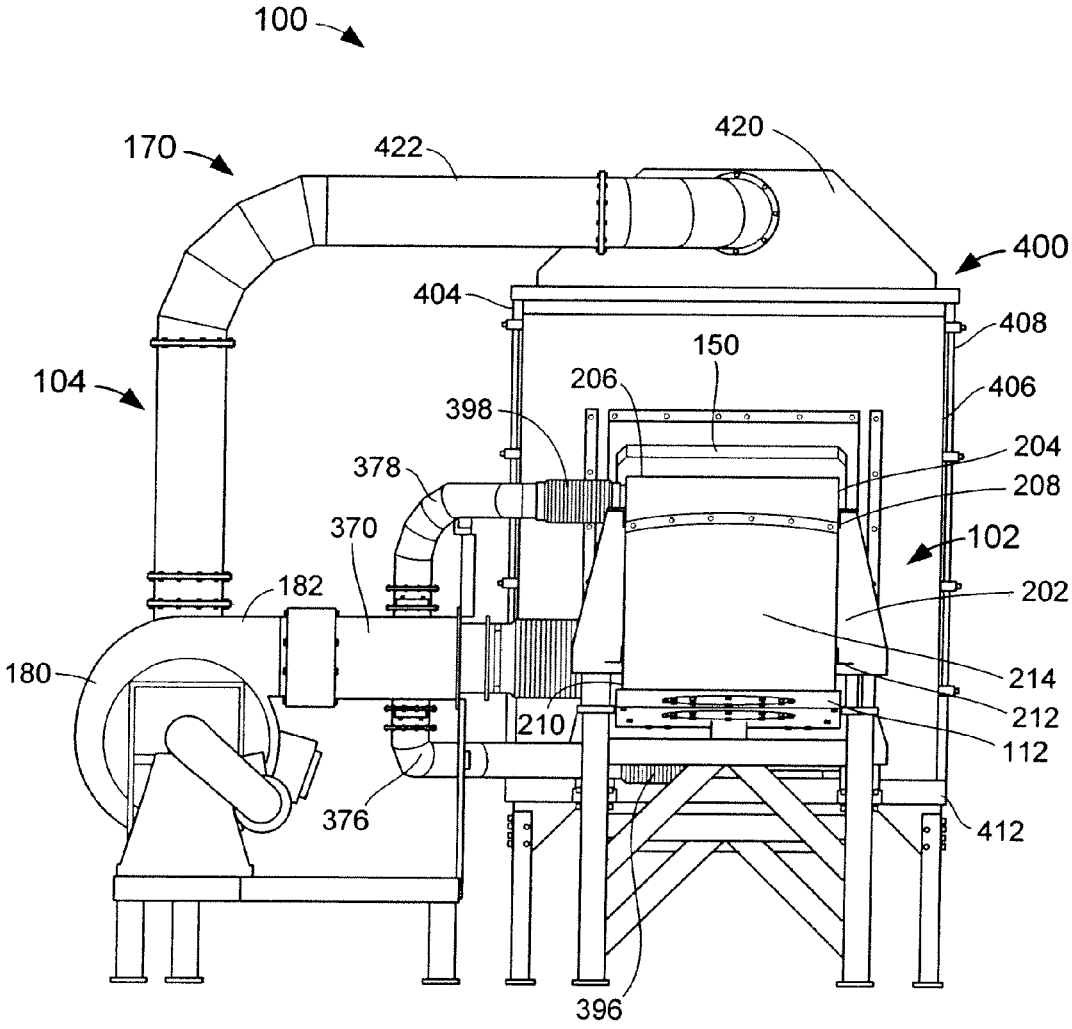
FIG. 6 is an end view of the system of FIG. 1.

Starting first with the apparatus 102, and referring in particular to FIGS. 3, 4 and 6, the housing 110 may include side walls 200, 202 and a top wall, or hood, 204, in addition to the floor 112. It will be recognized with reference to FIG. 6 that the side walls 200, 202 may have first ends 206, 208 attached to the floor 112 and second ends 210, 212 attached to the top wall 204. As such, the housing 110 forms a rectangular, parallelepiped shape as illustrated, although this should be viewed as an exemplary arrangement only.

The apparatus 102 may also include an end wall 214 (FIG. 3) that is attached to the side walls 200, 202. Edges of the side walls 200, 202, the top wall 204 and the end wall 214 define the inlet 118 to the chamber 116. While an end wall may be disposed at the opposite end of the housing 110, the illustrated embodiment lacks such an end wall. Instead, the edges of the floor 112, side walls 200, 202 and top wall 204 define the outlet 120.

As seen in FIG. 3, the deck 130 is disposed within the housing 110, and may be attached to the housing 110 by securing the edges of the deck 130 to the side walls 200, 202 of the housing 110, as is illustrated in FIG. 3 relative to side wall 200. In this regard, the deck 130 or sections thereof may have one or more brackets that are fastened to the side walls 200, 202 through the use of fasteners, such as bolts. As noted above, the deck 130 may include at least one section 132 that is in communication with the air handling system 104. However, as illustrated, the deck 130 includes other sections as well.

Starting then at the inlet end 118 of the chamber 116, a first section 220 of the deck 130 may have a plurality of apertures therethrough, with a chute 222 disposed below the first section 220 of the deck 130. The first section 220 may be referred to as a separation stage. The plurality of apertures may be defined by a mesh or screen, and may be used for an initial separation of materials entering the vibrator apparatus 102. Materials of a certain size and weight may pass through the first section 220 of the deck 130 and the chute 222. For example, the section 220 may include a plurality of apertures sized to allow particles below one-half inch in size to pass through. The materials passing through the chute 222 may be directed onto a separate conveyor, which may be a vibratory conveyor or a belt conveyor, for example. It will be recognized that according to variants, this section 220 may be replaced with a solid plate instead (thereby eliminating the separation action of this section of the deck 130).

The material that moves along the deck 130 past the first section 220 may pass under the top wall or hood 204. A flexible flap or curtain 230 may depend from an inner surface 232 of the hood 204, and may extend to an upper surface 234 of the deck 130. A lower edge 236 of the curtain 230 may abut the upper surface 234 of the deck 130, or may be spaced therefrom. The curtain 230 may be constructed of any suitable material, including, for example, cloth, rubber, and/or the like. The curtain 230 may assist confining the materials to the section of the chamber 116 between the curtain 230 and the outlet 120 of the chamber.

As better seen in FIG. 4, a second section 240 of the deck 130 may extend between the first section 220 and the section 132. The second section 240 may be defined by a deck plate 242 that has no apertures therethrough, unlike the sections 220, 132. An upstream end 244 of the plate 242 may abut a downstream end 246 of the first section 220, while a downstream end 248 may abut an upstream end 250 of the section 132 described above. The second section 240 of the deck 132 may also define, at least in part, the plenum 136 and a chamber 252 in communication with the air knife 140, as will be described in greater detail below.

The third section of the deck 130 is the section 132 discussed above with reference to FIG. 3, through which air from the first air flow path passes. As mentioned above, the section 132 has a plurality of apertures 134 therethrough. Although the apertures 134 may be defined by any number of different structure, the apertures 134 may be defined using a screen, and in particular a finger screen 260, as is illustrated in FIG. 4. A downstream end 262 of the section 132, and thus the finger screen 260, is proximate to the air knife 140; in particular, the downstream end 262 abuts a plate 264 used to define one of the surfaces 142, 144 of the air knife.

The section 132 of the deck 130 acts to fluidize the material moving over the screen 260. As such, the size of the apertures 134 may vary; bark chunks may require more fluidizing air and therefore may require larger apertures 134, while saw dust may require less fluidizing air and therefore may require smaller apertures 134, for example. Further, air passing through the apertures 134 causes the material passing over the deck 130 to tumble, agitating any large, bound-together clumps. The fluidizing air works the various sized parts of the disintegrating clumps, allowing the heavier fraction to collect at the bottom, or lower level, of the bed and the lighter, loose particles to bob and jump at the upper level of the bed. As a further consequence, the heavier particles may fall through the adjustable air stream formed by the air knife 140 into the opening 114 while the lighter particles may be picked up by the air stream formed by the air knife 140.

Between the air knife 140 and the outlet 120 of the chamber 116 is the opening 114 in the floor 112. The opening 114 may be referred to as a dropout opening. Once the materials moving along the deck 130 become fluidized while passing over section 132 of the deck 130, the materials pass over the air knife 140, which causes certain of the materials to be blown out over the opening 114, while other materials pass into the opening 114. To permit a greater adjustability as to the selectivity of the separation caused by the air knife 140, the apparatus 102 may include a plate assembly 270 (which may be referred to as a landing plate) that may have an adjustable length and angular position, as is illustrated in FIG. 4.

In particular, the plate assembly 270 may includes a first plate 272 having side plates disposed on either side, one of the side plates 274 being shown in FIG. 4. The side plates 274 are pivotally attached at a first end 276 through the use of a pivot rod 278, for example, that passes through the side walls 200, 202 is secured thereto by, for example, using fasteners such as nuts and bolts. A second end 280 is attached to an adjustment mechanism, which may include a second rod 282 that is received in an arcuate slot 284, which rod may be secured in a particular position along the slot 284 to selectively secure the plate assembly 270 in a particular angular position. A second, extension plate 286 is translatably mounted on the first plate 272, and is translatable toward and away from the opening 114. The extension plate 286 also has side walls 288, and fasteners 290 that may be used to selectively secure the plate 286 relative to the plate 272.

Turning now to the space below the second and third sections 240, 132 of the deck 130, it will be recognized that two chambers or plenums are defined between the deck 130 and the floor 112 of the housing 110. One of these chambers is the plenum 136, while the other is the chamber 252 in communication with the air knife 140 and the second air flow path 162. In particular, the plenum 136 is defined at either side by the side walls 200, 202, above by the deck plate 242 and the finger screen 260, and below by a separation plate 302 (part of which may define the plate 264). The plenum 300 is defined at either side by the side walls 200, 202, above by the deck plate 242 and the separation plate 302, below by the floor 112, at one end by an end plate 304 that defines in part the chute 222, and at the other end by an adjustable deflector plate 306.

In the illustrated example, the portion 264 of the separation plate 302 and the deflector plate 306 may define the surfaces of 142, 144 of the air knife 140. The first surface 142 of the air knife 140 (and thus the plate 264, for example) has a first end 320 and a second end 322, and the second surface 144 of the air knife 140 (and thus the plate 306) has a corresponding first end 324 and a corresponding second end 326. The second surface 144 is translatable between a first position, wherein the second surface 144 is shifted towards the first surface 142 so that the first ends 320, 324 and second ends 322, 326 of the first and second surfaces 142, 144 have a first spacing therebetween, and a second position, wherein the second surface 144 is shifted away from the first surface 142 so that the first ends 320, 324 and second ends 322, 326 of the first and second surfaces 142, 144 have a second spacing therebetween, the second spacing being larger than the first spacing.

The first, or narrow, spacing may provide a high velocity air stream from the air knife 140. The high velocity air stream may be well suited for separating two or more commingled, relatively light objects, such as paper and glass. The second, wider, spacing may provide a lower velocity air stream. The low velocity air stream may be well suited for separating other, heavier commingled objects, such as wood and rock.

The apparatus 102 may be suspended, as illustrated such that the housing 110 slopes generally downward from the inlet 118 towards the outlet 120 to assist in motion of the mixture as described below. As seen in FIGS. 1-3, resilient isolation members 340 may be disposed between the housing 110 and a frame 342 that is disposed on the ground, for example. The resilient members 340 may be, for example, marshmallow-type springs. It will be appreciated, however, that any other suitable spring, or suspension system for that matter, may be used.

As also seen in FIGS. 1-3, the apparatus 102 includes a vibration generator 150, an exemplary embodiment of which is illustrated. As illustrated in FIG. 3, the generator 150 includes a motor 350 having a shaft 352 with a pair of eccentric weights 354 (only one of which is illustrated in FIG. 3) mounted at the ends thereof. The motor 350 is coupled to the housing 110 via on or more resilient members 356, which may be coil springs as illustrated and may be referred to as reactor springs. The vibration generator 350 is thus a two-mass system, although it will be recognized that brute force and other type of generators may also be used with the apparatus 102 according to the present disclosure.

Turning now to the air handling system 104 as illustrated in FIGS. 1, 2 and 5-7, each of the air flow paths 160, 162, 164, 166, 170 is defined by at least one or more conduits. Certain of these air flow paths also include one or more dampers, or slide gates, to control the flow of air through the conduits. It will be recognized that the dampers permit a single air mover, in the form of a centrifugal fan, for example, to be used for all of the air flow paths. According to alternative embodiments, the air flow paths 160, 162, 164, 166 may have their own separate air movers associated therewith, and the control of the flow of the air through these paths 160, 162, 164, 166 may be through the use of variable frequency drives instead of dampers. At least one of these paths, the return air flow path 170, may include devices other than conduits and dampers; as illustrated, the return air flow path may include an expansion box and a fresh air inlet.

Figure 5:
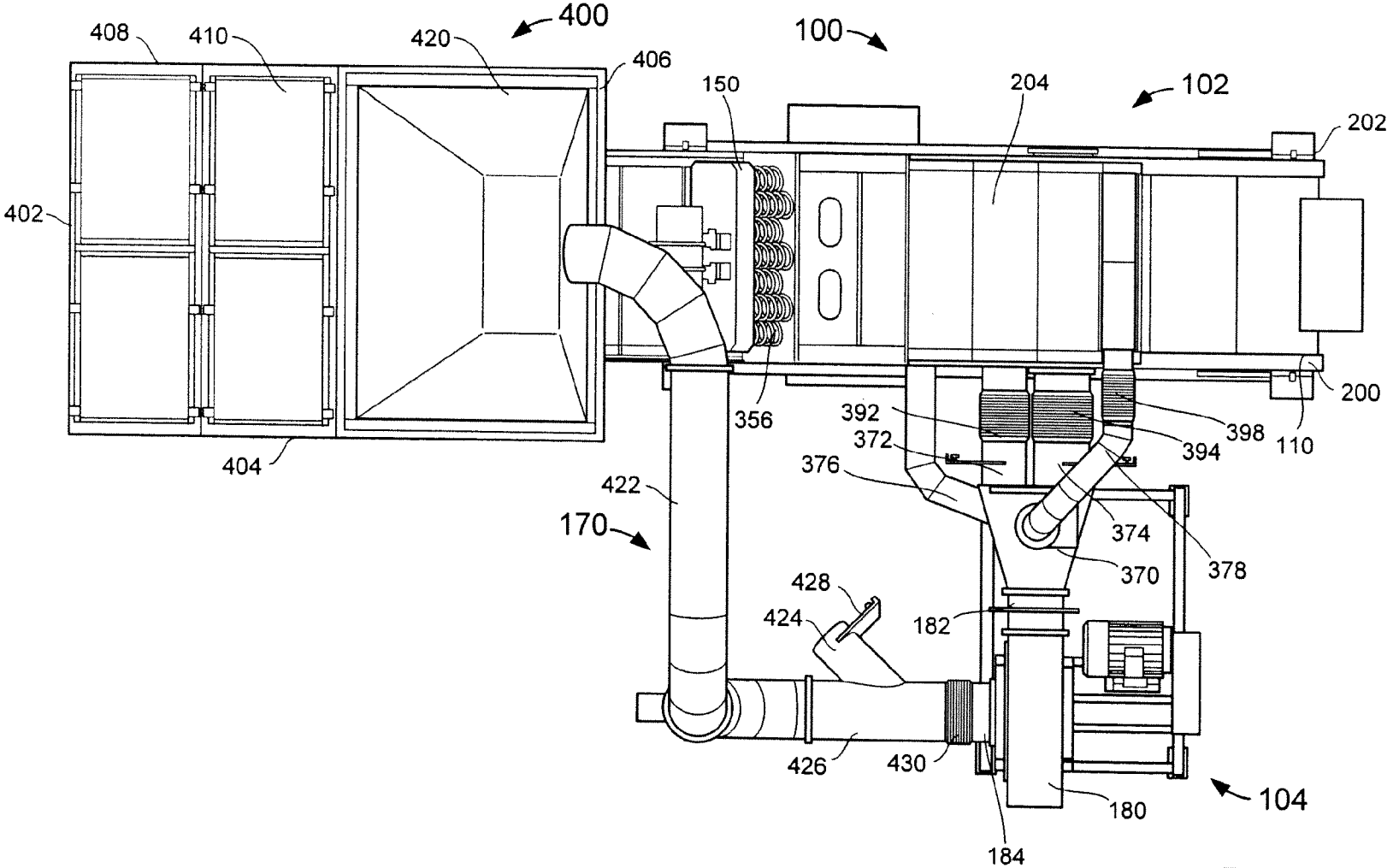
FIG. 5 is a plan view of the system of FIG. 1.
Figure 7:
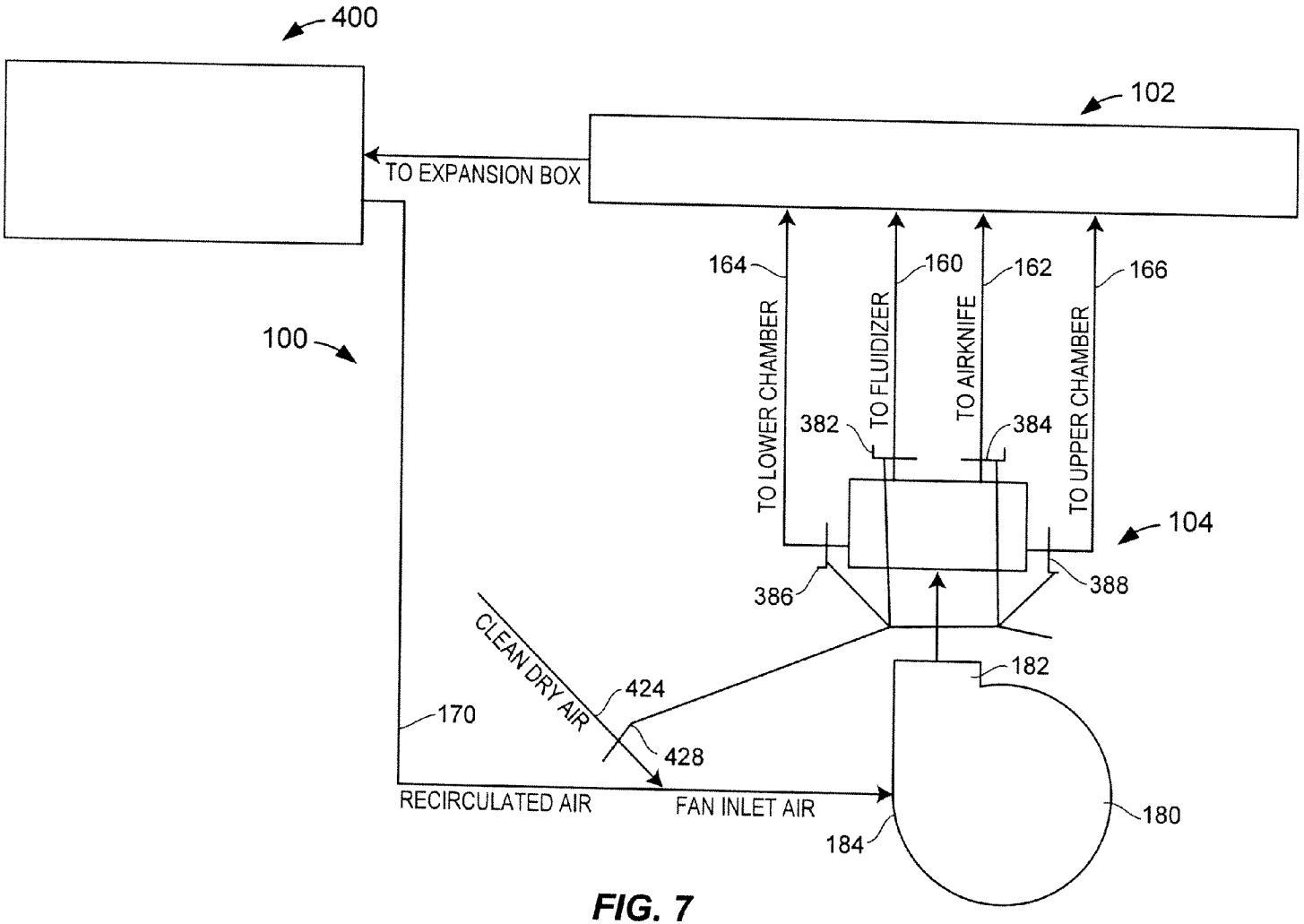
FIG. 7 is a schematic view of the system of FIG. 1 illustrating the flow of air through the system.

Starting then at the outlet 182 of the air mover 180 with reference to FIGS. 5 and 6, a single conduit 370 branches into four conduits 372, 374, 376, 378, one each for each of the four air flow paths 160, 162, 164, 166. As illustrated in FIG. 7, each of the conduits 372, 374, 376, 378 has a damper 382, 384, 386, 388 associated therewith. Further, each conduit 372, 374, 376, 378 has a flexible connector 392, 394, 396, 398 associated therewith (see FIGS. 5 and 6); the flexible connectors 392, 394, 396, 398 accommodate the movement of the vibratory apparatus 102 during operation of the system.

The return air flow path 170 includes more than conduits, dampers and connectors. As illustrated in FIGS. 1, 2, and 5-7, the return air flow path 170 includes an air expansion box 400 connected to the outlet 120 of the chamber 116. The air expansion box 400 has walls 402, 404, 406, 408, 410 defined by one or more panels made of a mesh material, for example. The bottom 412 of the box 400, by contrast, is open to a conveyor, such as a belt conveyor as illustrated. The box 400 permits the air exiting the outlet 120 to undergo expansion upon exiting the apparatus 102.

The wall 410 is also defined in part by a hood 420 that collects the air entering the box 400, and directs the air into a conduit 422. The conduit 422 is connected to an inlet 424 (see FIGS. 5 and 7) through which fresh air from the surrounding environment may enter the air handling system 104 at a Y-connection 426. The inlet 424 is covered by a damper 428, which may be moved between an open state and a closed state to control the amount of fresh air entering the system 104. The Y-connection 426 is connected to the inlet 184 of the air mover 180 via a flexible connector 430.

While no system has been illustrated for the automated operation of the air handling system 104 has been illustrated, it will be recognized that the manual operation of the air mover 180 and the dampers 382, 384, 386, 388, 428 may be coordinated using automated methods. For example, one or more controllers may be connected to control the operation of the air mover 180 (through the use of a variable frequency drive, for example) and the movement of the dampers 382, 384, 386, 388, 428 (through the use of electromechanical actuators) so as to permit the air handling system 104 to be controlled from a single point, if not by a single controller. The control of the air handling system 104 may even be automated to as to be coordinated with the operation of the apparatus 102 to permit unified control of the entire system 100.

In operation, an air flow may be selected for the first and second air flow paths 160, 162 so as to optimize the fluidization and separation of the material passing through the apparatus 102 with the vibration generator 150 operating to move material along the deck 130. At the same time, air flow may be selected for the third air flow path 164 to balance the negative air pressure that builds below the air knife 140 to maintain a slight negative pressure within the chamber 120. Similarly, air flow may be selected for the fourth air flow path 166 to balance the negative pressure that builds upstream of the section 132 of the deck 130 to maintain the slight negative pressure. The air for each of the paths 160, 162, 164, 166 is obtained from the return air flow path 170, and potentially the fresh air inlet 424. The selection of the air flows 160, 162, 164, 166 may involve control of the operation of the air mover 180, as well as movement of the dampers 382, 384, 386, 388 and 428.

It will be recognized that the system according to the present disclosure may present one or more advantages relative to prior systems. According to any particular embodiment of the present system, any or all of these advantages may be present.

What is claimed is:

1. A system comprising:

(i) a vibratory apparatus comprising:

a housing having a floor with an opening therethrough, the housing defining a chamber with an inlet and an outlet, a deck disposed in the chamber between the inlet and the opening in the floor, at least a section of the deck having a plurality of apertures to permit air to flow through the section of the deck and a plenum defined beneath the section of the deck, an air knife disposed between the section of the deck and the outlet, the air knife comprising first and second surfaces spaced from each other to guide air therebetween, a vibration generator coupled to the deck to cause motion of material along the deck; and (ii) an air handling system comprising:

a first air flow path in communication with the plenum, a second air flow path in communication with the air knife, a third air flow path in communication with a space beneath the air knife, a fourth air flow path in communication with the chamber above the deck between the inlet and the section of the deck, a return air flow path from the outlet of the chamber, and an air mover having an outlet in communication with the first, second, third, and fourth air flow paths and an inlet in communication with the return air flow path.

2. The system according to claim 1, wherein the third air flow path is disposed below the second surface of the air knife.

3. The system according to claim 1, wherein each of the first, second, third, and fourth air flow paths is defined in part by a conduit having a damper disposed therein to control the flow of air through each of the first, second, third, and fourth air flow paths.

4. The system according to claim 1, wherein the system comprises an air expansion box disposed between the outlet of the chamber and the inlet of the air mover, the air expansion box comprising a housing having walls defined by mesh panels.

5. The system of claim 1, wherein the inlet of the air mover is also in communication with a fresh air inlet in communication with the environment.

6. The system according to claim 1, wherein the deck is attached to the housing and spaced from the floor.

7. The system according to claim 1, wherein the section of the deck has an upstream end and a downstream end, the air knife disposed at the downstream end of the section of deck.

8. The vibratory apparatus according to claim 1, wherein:

the first surface of the air knife has a first end and a second end, and the second surface of the air knife has a corresponding first end and a corresponding second end, the second surface being translatable between a first position, wherein the second surface is shifted towards the first surface so that the first ends and second ends of the first and second surfaces have a first spacing therebetween, and a second position, wherein the second surface is shifted away from the first surface so that the first ends and second ends of the first and second surfaces have a second spacing therebetween, the second spacing being larger than the first spacing.

* * * * *